US006705545B1

(12) United States Patent
Sroka et al.

(10) Patent No.: US 6,705,545 B1
(45) Date of Patent: Mar. 16, 2004

(54) QUICK COLOR CHANGE POWDER PAINT SYSTEM

(75) Inventors: Jerome J. Sroka, Kentwood, MI (US); Steven C. Martin, West Olive, MI (US); Patrick J. Fingleton, Grand Rapids, MI (US); Eugene C. Jager, Walkerville, MI (US); Robert W. Meyer, West Olive, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/696,061

(22) Filed: Oct. 25, 2000

Related U.S. Application Data

(63) Continuation-in-part of application No. 09/628,634, filed on Jul. 31, 2000, now Pat. No. 6,315,214, which is a continuation of application No. 09/191,892, filed on Nov. 13, 1998, now Pat. No. 6,112,999.

(51) Int. Cl.[7] ..... B05B 15/02

(52) U.S. Cl. ..... 239/112; 239/143; 239/305; 239/307; 239/310; 239/311; 239/325

(58) Field of Search ..... 239/654, 112, 239/113, 142, 143, 303–305, 307, 310, 311, 318, 325; 137/625.11

(56) References Cited

U.S. PATENT DOCUMENTS

| | | | | |
|---|---|---|---|---|
| 1,758,552 A | | 5/1930 | Allen et al. | |
| 2,257,004 A | | 9/1941 | Fleming | 91/45 |
| 2,339,379 A | | 1/1944 | Cook | 299/88 |
| 3,084,870 A | | 4/1963 | Hagadorn | 239/305 |
| 3,674,205 A | | 7/1972 | Kock | 239/1 |
| 3,674,207 A | * | 7/1972 | Carbonetti et al. | 118/323 |
| 3,782,632 A | | 1/1974 | Braun et al. | 239/112 |
| 3,924,810 A | | 12/1975 | Otterstetter | 239/305 |
| 4,170,074 A | | 10/1979 | Heckman et al. | 34/57 |
| 4,248,379 A | | 2/1981 | Hollstein et al. | 239/1 |
| 4,302,481 A | | 11/1981 | Ribnitz et al. | 427/27 |
| 4,508,271 A | | 4/1985 | Gress | 239/305 |
| 4,509,684 A | | 4/1985 | Schowiak | 239/112 |
| 4,526,191 A | | 7/1985 | Pomponi, Jr. | 137/206 |
| 4,586,854 A | * | 5/1986 | Newman et al. | 137/888 |
| 4,590,884 A | | 5/1986 | Kreeger et al. | 118/308 |
| 4,697,741 A | | 10/1987 | Dengler et al. | 239/391 |
| 4,728,033 A | | 3/1988 | Matsumura et al. | 239/1 |
| 4,770,344 A | | 9/1988 | Kaiser | 239/8 |
| 4,823,731 A | | 4/1989 | Howeth | 118/326 |
| 4,824,295 A | | 4/1989 | Sharpless | 406/109 |
| 4,898,116 A | | 2/1990 | Kozoe et al. | 118/621 |
| 4,953,495 A | | 9/1990 | Salisbury | 118/70 |
| 4,957,060 A | | 9/1990 | Cann | 118/699 |
| 5,086,978 A | | 2/1992 | Fertig | 239/305 |
| 5,107,756 A | | 4/1992 | Diaz | 454/53 |
| 5,170,591 A | | 12/1992 | Brielmaier et al. | 51/320 |
| 5,192,595 A | | 3/1993 | Akeel et al. | 427/421 |
| 5,215,261 A | | 6/1993 | Frene | 239/704 |
| 5,221,047 A | | 6/1993 | Akeel | 239/123 |
| 5,256,201 A | | 10/1993 | Gelain et al. | 118/326 |
| 5,288,324 A | | 2/1994 | Shaneyfelt | 118/326 |

(List continued on next page.)

*Primary Examiner*—Charistopher Kim
(74) *Attorney, Agent, or Firm*—Price, Heneveld, Cooper, DeWitt & Litton, LLP

(57) ABSTRACT

A paint system including at least one spray gun located, a paint line changing assembly and a plurality of differently colored paint sources. The paint line changing assembly is configured to selectively connect the at least one spray gun with one of the plurality of differently colored paint sources. The paint system further includes a controller for maintaining at least one of the plurality of differently colored paint sources in a partially fluidized state when not connected to the at least one spray gun and for maintaining the one of the plurality of differently colored paint sources in an operative fluidized state when connected to the at least one spray gun.

45 Claims, 4 Drawing Sheets

U.S. PATENT DOCUMENTS

| | | | | |
|---|---|---|---|---|
| 5,289,947 | A | 3/1994 | Akeel et al. | 222/108 |
| 5,389,149 | A | 2/1995 | Carey et al. | 118/302 |
| 5,591,240 | A | 1/1997 | Ophardt et al. | 55/217 |
| 5,645,380 | A | 7/1997 | Rutz | 406/153 |
| 5,676,756 | A | 10/1997 | Murate et al. | 118/629 |
| 5,704,957 | A | 1/1998 | Rutz | 55/503 |
| 5,765,971 | A | 6/1998 | Rutz | 406/123 |
| 5,772,764 | A | 6/1998 | Akimoto | 118/319 |
| 5,776,249 | A | 7/1998 | Rutz | 118/308 |

* cited by examiner

QUICK COLOR CHANGE POWDER PAINT SYSTEM

This application is a continuation-in-part of application No. 09/628,634, filed Jul. 31, 2000 (now U.S. Pat. No. 6,315,214, issued Nov. 13, 2001) entitled METHOD FOR CONTROLLING POWDER PAINT SYSTEM, which is a continuation of application No. 09/191,892, filed Nov. 13, 1998 (now U.S. Pat. No. 6,112,999, issued Sep. 5, 2000) entitled POWDER PAINT SYSTEM AND CONTROL THEREOF.

BACKGROUND OF THE INVENTION

The present invention concerns a powder paint system that includes an arrangement permitting quick color change and that minimizes paint lost when making the color change.

Colored powder paint must be completely purged from a paint line and spray gun, particularly when changing from a dark color to a light color, so that residue paint from the previous color does not discolor the next color. A problem is that this leads to slow cycle times, wasted labor, and process inefficiencies. Also, existing purge methods lead to considerable waste in the form of purged material that must be landfilled, which could be very expensive, particularly if the landfilled materials are potential pollutants to the environment.

Some manufacturers have chosen to use a different paint line and spray gun for each color. However, this requires a large capital expenditure for equipment. Further, the equipment takes up space and each station requires constant maintenance and upkeep, whether or not it is used.

Another problem is that the particles of the powder paint will degrade if kept in a fluidized state ready for use over long periods of time. Powder paints must be fluidized (i.e., suspended in air or a gaseous carrier), so that a uniform and steady flow of particles of powder paint can be picked up and carried to a part upon demand. Degradation occurs because collisions between particles affect the particle surfaces and also cause the particles to become smaller in size. Where a high voltage charge is used to assist in depositing the powder paint onto a part, the degraded powder materials have a reduced ability to pick up or hold a high voltage charge.

Accordingly, an apparatus solving the aforementioned disadvantages and having the aforementioned advantages is desired.

SUMMARY OF THE INVENTION

One aspect of the present invention is to provide at least one spray gun, a paint line changing assembly and a plurality of differently colored paint sources. The paint line changing assembly is configured to selectively connect the at least one spray gun with one of the plurality of differently colored paint sources. The paint system further includes a controller for maintaining at least one of the plurality of differently colored paint sources in a partially fluidized state when not connected to the at least one spray gun and for maintaining the one of the plurality of differently colored paint sources in an operative fluidized state when connected to the at least one spray gun.

Another aspect of the present invention is to provide a method of painting including providing at least one spray gun, a paint line changing assembly and a plurality of differently colored paint sources. The method also includes selectively connecting the at least one spray gun to one of the plurality of differently colored paint sources with the paint line changing assembly. At least one of the plurality of differently colored paint sources is maintained in a partially fluidized state when not connected to the at least one spray gun and the one of the plurality of the differently colored paint sources is maintained in an operative fluidized state when connected to the at least one spray gun.

Yet another aspect of the present invention is to provide a paint system including a paint line changing assembly and a plurality of differently colored paint sources. The paint line changing assembly is configured to automatically and selectively connect at least one spray gun with one of the plurality of differently colored paint sources. The paint system also includes a controller for maintaining at least one of the plurality of differently colored paint sources in a partially fluidized state when not connected to the at least one spray gun and maintaining the one of the plurality of differently colored paint sources in an operative fluidized state when connected to the at least one spray gun.

In yet another aspect of the present invention, a paint system is provided wherein the paint system includes a plurality of differently colored paint sources, a purging air source, a spray gun and a paint line changing assembly. The paint line changing assembly includes a first manifold and a second manifold. The first manifold includes an axis and a plurality of first passageways parallel to the axis of the first manifold, with each of the first passageways of the first manifold being in fluid communication with one the plurality of differently colored paint sources and the air source. The second manifold includes an axis and a second passageway parallel to the axis of the second manifold. The second passageway of the second manifold is in fluid communication with the spray gun. The second manifold is also rotatably connected to the first manifold along their respective axes. The plurality of passageways in the first manifold are configured to be automatically and selectively aligned with the passageway of the second manifold, thereby automatically fluidly connecting one of the plurality of differently colored paint sources or the air source to the spray gun.

Another aspect of the present invention is to provide a paint system having a plurality of differently colored paint sources, a plurality of spray guns and a paint line changing assembly. The paint line changing assembly includes a first body and a second body. The first body includes a plurality of sets of first passageways, with each set of first passageways being in fluid communication with a different one of the plurality of different paint sources. The second body includes a set of second passageways in fluid communication with the plurality of spray guns. The paint system further includes a support for the first and second bodies. One of the first body and the second body is configured to move relative to the support in a first direction parallel to the longitudinal direction. Moreover, the other of the first body and the second body is configured to move in a second direction different from the first direction to selectively align one of the sets of first passageways in the first body with the set of second passageways of the second body, thereby fluidly connecting one of the plurality of differently colored paint sources to the plurality of spray guns.

The principal objects of the present invention include providing a paint system for quickly changing the color of powder paint. The paint system can be used automatically to paint various items or products. The paint system can also be used to automatically and repetitively paint items or products with different colors. Therefore, the paint system provides reduced manufacturing costs for painting items or products. The paint system further prevents color cross contamination of a subsequent color sprayed. The paint system is efficient in use, economical to manufacture, capable of a long operable life, and particularly adapted for the proposed use.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
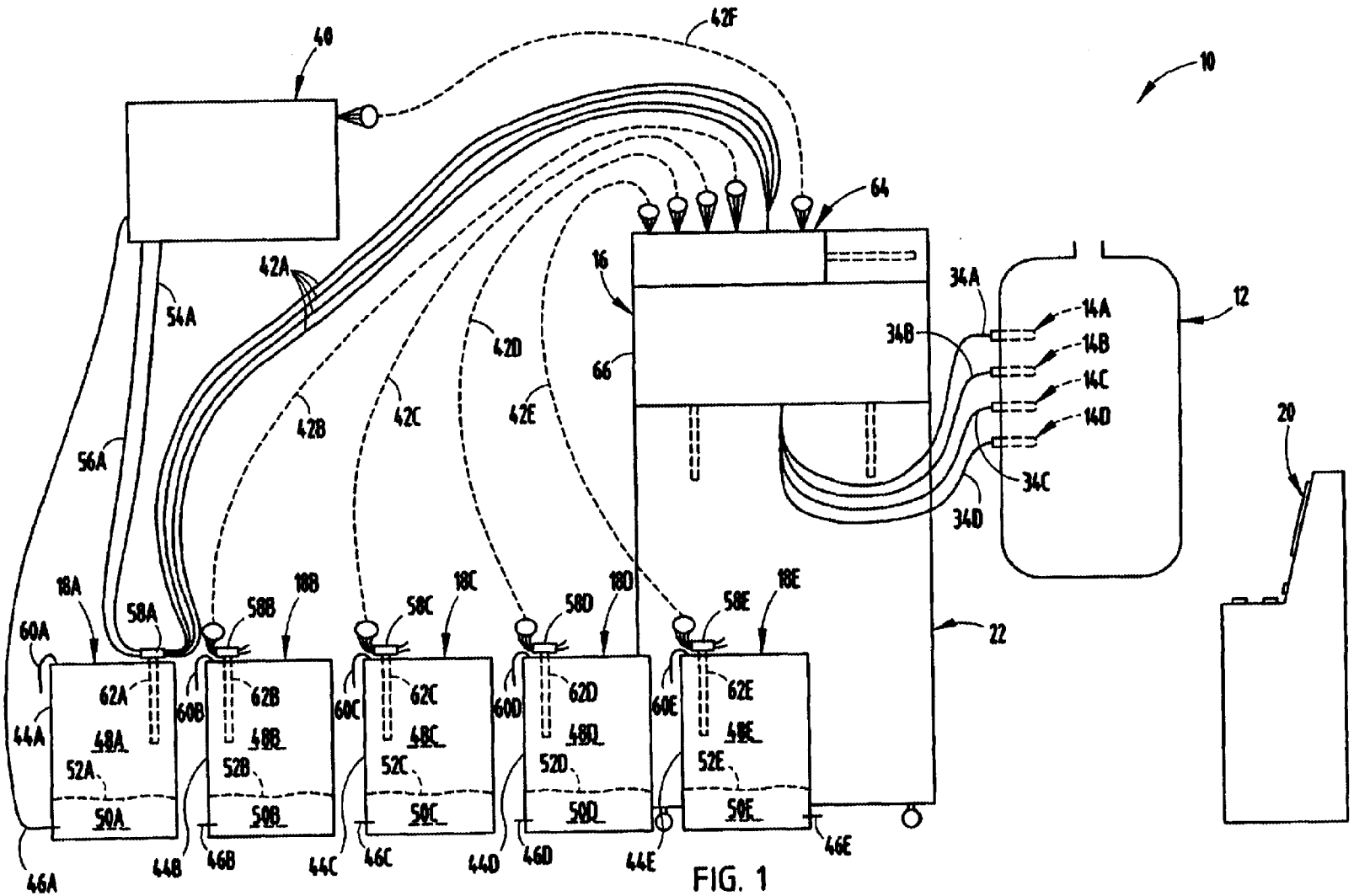
FIG. 1 is a perspective view of a paint system embodying the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a paint system embodying the present invention. In the illustrated example, the paint system 10 includes at least one spray gun 14A–14D, a paint line changing assembly 16 and a plurality of differently colored paint sources 18A–18E. The paint line changing assembly 16 is configured to selectively connect the at least one spray gun 14A–14D with one of the plurality of differently colored paint sources 18A–18E. The paint system 10 further includes a controller 20 for maintaining at least one of the plurality of differently colored paint sources 18A–18E in a partially fluidized state when not connected to the at least one spray gun 14A–14D and for maintaining the one of the plurality of differently colored paint sources 18A–18E in an operative fluidized state when connected to the at least one spray gun 14A–14D.

In the illustrated paint system 10, the at least one spray gun 14A–14D is located within a spray booth 12 and the paint line changing assembly 16 is positioned outside of the spray booth 12. The illustrated spray guns 14A–14D are configured to paint products (not shown) traveling through the spray booth 12 with powdered paint. The products can travel through the spray booth 12 on a conveyor belt 26, in any other manner or could be stationary. Furthermore, the products could be traveling on devices such that the products would be spun, raised, lowered, etc. in order to thoroughly paint the entire product. In the illustrated example, four spray guns 14A–14D are located within the spray booth 12, although, the spray booth 12 could employ any number of spray guns. The illustrated spray guns 14A–14D are preferably locked in a fixed position within the spray booth 12 in order to automatically paint the products by forcing powdered paint out of the nozzles of the spray guns 14A–14D as the products pass by the spray guns 14A–14D. The spray guns 14A–14D are electronically connected to the controller 20 for triggering the flow of paint from the spray guns 14A–14D and for controlling the electrostatic charges generated in the spray guns 14A–14D for charging the powder paint to assist in depositing the powder paint on the products. The spray guns 14A–14D are preferably horizontally and vertically adjustable so the spray guns 14A–14D can be positioned to properly and thoroughly paint the products. Although the spray guns 14A–14D are locked in a fixed position in the spray booth 12 for automatic painting, the spray guns 14A–14D could also be allowed to move within the spray booth 12 and could include triggers for manually spraying the products. Spray guns 14A–14D, electrical controls and means for controlling the electrostatic charges are known in the art, such that they do not need to be described for a complete understanding of the present invention. Each of the spray guns 14A–14D include a spray gun hose 34A–34D extending from the spray guns 14A–14D to the paint line changing assembly 16 for delivering powdered paint to the spray guns 14A–14D. Four spray gun hoses 34A–34D are shown in FIG. 1 because four spray guns 14A–14D are shown, but any number of spray gun hoses could be used, depending on the number of spray guns.

In the illustrated example, the controller 20, the paint line changing assembly 16 and a plurality of differently colored paint sources 18A–18E are located outside of the spray booth 12. With the controller 20, paint line changing assembly 16 and paint sources 18A–18E being located outside of the spray booth 12, the above elements can be controlled, changed, worked on, etc. by a person without the person coming into contact with the powdered paint typically floating about in the spray booth 12, thereby providing a better working environment. Furthermore, locating the paint line changing assembly 16 outside of the spray booth 12 allows it to be readily accessible to a technician. The controller 20 includes a programmable logic controller (PLC) and could be located anywhere in the building housing the spray booth 12. The controller 20 can be programmed to automatically activate the spray guns 14A–14D, generate electrostatic charges in the spray guns 14A–14D, and as discussed in more detail below, connect the spray guns 14A–14D with one of the plurality of different colored paint sources 18A–18E, purge paint in the paint system 10, maintain at least one of the plurality of differently colored paint sources 18A–18E in the partially fluidized state and maintain one of the plurality of differently colored paint sources 18A–18E in the operative fluidized state. Controllers 20 are known in the art, such that they do not need to be described for a complete understanding of the present invention.

The illustrated paint line changing assembly 16 is connected to each of the spray gun tubes 34A–34E linked to the spray guns 14A–142 and also to a plurality of sets of source tubes 42A, 42B, etc. Each set of source tubes 42A, 42B, etc. is shown as containing four source tubes. For example, a first set includes four of the source tubes 42A. However, like the spray gun hoses, the number of source tubes in each set depends on the number of spray guns. Five of the sets of source tubes 42A–42E are linked to one of the plurality of different colored paint sources 18A–18E (although each set of source tubes 42B–42E between sources 18B–18E and the paint line changing assembly 16 are shown as one dashed line), respectively, and one set of source tubes 42F is connected to a purging air source and valving control box assembly 40 for purging the paint system 10, as described in more detail below. Although six sets of source tubes 42A–42F are shown in FIG. 1, the number of source tubes can vary, depending on the number of differently colored paint sources. For example, if there are seven differently colored paint sources, the paint system 10 would require eight source tubes (seven source tubes for the differently colored paint sources and one source tube for the purging air source and valving control box assembly 40). The paint line changing assembly 16 is configured to selectively connect the spray gun tubes 34A–34D to one of the sets of source tubes 42A–42F for connecting the spray guns 14A–14D with one of the differently colored paint sources 18A, 18B, etc. or the source tube 42F for connecting the spray guns 14A–14D to the purging air source and valving control box assembly 40. For example, the paint line changing assembly 16 can connect all of the spray guns 14A–14D to the first set of source tubes 42A, and therefore to one of the plurality of differently colored paint sources 18A.

In the illustrated example, each of the plurality of differently colored paint sources 18A–18E includes a supply tank or canister 44A–44E containing powdered paint. To avoid repetitious and redundant discussion, the features and components for one of the canisters 44A will be described, it being understood that identical features and components for each of the canisters will have identical numbers for identical features and components, but with the addition of the letters "A," "B," "C," "D" and "E" for the features and components of each canister 44A–44E. The canister 44A is fluidly connected to the paint line changing assembly 16 and to the purging air source and valving control box assembly 40. Powder fluidization line 46A extends from a fluidization valving arrangement in the purging air source and valving control box assembly 40 to a bottom of the canisters 44A. The illustrated canister 44A is barrel shaped, optimally suited for providing a swirling fluidizing action to suspend powder paint particles. The canister 44A includes an upper chamber 48A for holding fluidized powder paint and a lower chamber 50A for receiving fluidization air from the fluidization line 46A that passes upwardly into the upper chamber 48A. A porous filter/wall 52A separates the upper and lower chambers 48A and 50A and permits the fluidizing air to flow upwardly from the lower chamber 50A into the upper chamber 48A in a manner fluidizing the powder paint. This keeps the powder paint suspended and dispersed, so that it is ready to be carried to the spray guns 14A–14D for application. A powder delivery airflow line 54A and a powder atomization line 56A extend from the respective valving arrangement in the purging air source and valving control box assembly 40 to a pump.58A on the top of the canister 44A. The airflow line 54A provides the airflow to pump 58A necessary to provide a venturi effect to suck fluidized powder paint into the air stream traveling along the source tubes 42A to the spray guns 14A–14D. The atomization line 56A provides an additional volume of air that is necessary to create the total airflow desired. The atomization air lets the speed of the total airflow and also the dispersion of powder paint in the total airflow to be adjusted to desired values for optimal painting. A vent line 60A extends from a top of the canister 44A for venting excess fluidization air fed into the canister 44A. The illustrated pump 58A includes a suction tube 62A that extends about ⅔ of the way down into the canister 44A. Notably, although a specific supply tank is shown, it is contemplated that the present invention is broad enough to include various tank configurations and pump arrangements, and accordingly the present description of these components is intended only to facilitate an understanding of the present invention. Although only one canister 44A is illustrated as being connected to each of the source tubes 42A, each source tube 42A could be connected to a different canister 44A, with each canister 44A containing an identical color of powdered paint. A paint line changing assembly that can be automated, and the above features and components for one of the canisters 44A, the purging air source and the valving control box are the subject matter of commonly assigned U.S. Pat. No. 6,112,999, hereby incorporated by reference, except that in the present invention one of the sets of source tubes 42F is permanently connected to the source of purging air, the source of purging air forces powdered paint through the spray gun hoses 34A–34E instead of back into the canisters 44A–44E and the controller 20 controls all of the systems in the valving control box and an air to gun control valve.

The illustrated purging air source and valving control box assembly 40 is configured, under direction from the controller 20, to maintain at least one of the plurality of differently colored paint sources 18A–18E in a partially fluidized state when not connected to the at least one spray gun 14 and to maintain one of the plurality of differently colored paint sources 18A–18E in an operative fluidized state when connected to the spray guns 14A–14D by providing a selected amount of air through the selected powder fluidization line 46A–46E. The paint sources 18A–18E in the partially fluidized state are at a standby fluidization pressure that is adjusted by regulator to a minimum pressure condition to minimize particle degradation over time, but so that the particles of powder paint are sufficiently suspended to prevent agglomeration and to allow a quick increase to the operational airflow/pressure without undue delay. The paint sources 18A–18E in the operative fluidized state are in an operating condition, wherein the particles of the powder paint are excited to a higher state such that they are optimally suspended to be drawn into the airflow traveling through the source tubes 42A–42E to the spray guns 14A–14D for application to a part. For example, this fluidization pressure may be about double the standby fluidization pressure. It is noted that the standby and operational fluidization pressures are very dependent upon the length and size of hoses and the supply lines, the input main air pressure, the equipment, the powder paint, and the components used in the overall system 10.

Figure 2:
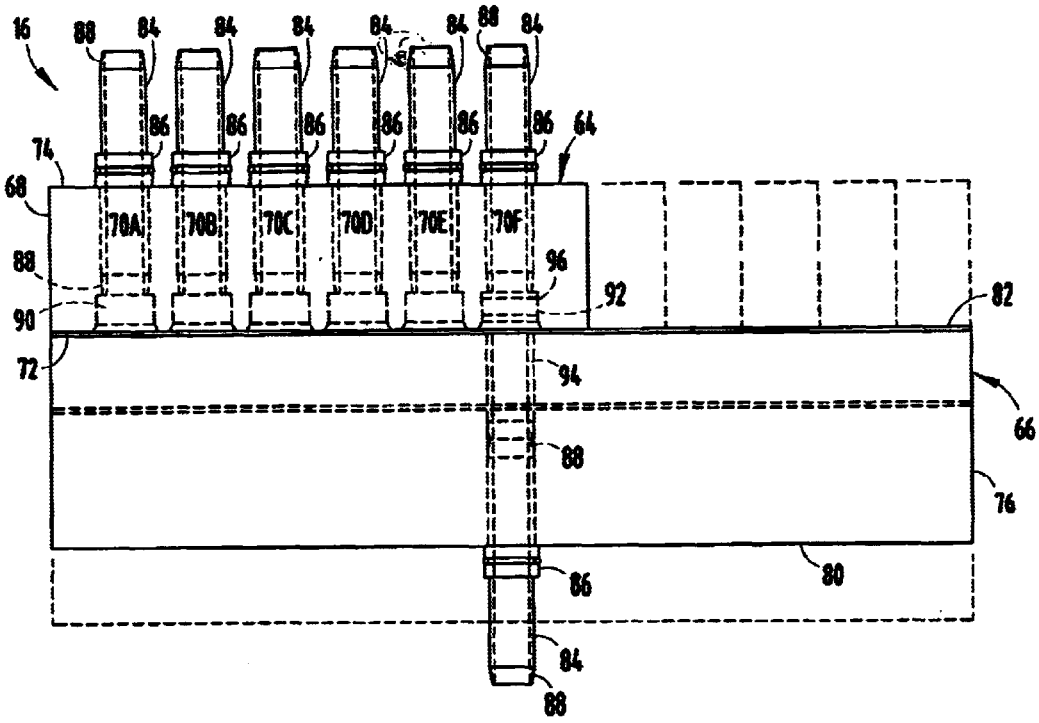
FIG. 2 is a front view of a first body and a second body of a first embodiment of a paint line changing assembly of the present invention.

The illustrated paint line changing assembly 16 (FIGS. 24) includes a first body 64 positioned adjacent a second body 66. As described in more detail below, the first body 64 is in fluid communication with the plurality of differently colored paint sources 18A–18E and the second body 66 is in fluid communication with the spray guns 14A–14D. The first body 64 and the second body 66 are connected to a support, shown as a movable rack 22 in FIG. 1. The support 22 could also be any wall of the building that houses the spray system 10 or any other movable support. The illustrated first body 64 comprises a first rectangular block 68 with a plurality of sets of parallel first passageways 70A–70F (with 70A–70E shown in phantom in FIG. 3) extending from a bottom surface 72 of the first rectangular block 68 to a top surface 74 of the first rectangular block 68 in a four by six matrix, with each set of first passageways 70A, 70B, etc. being in a four by one matrix. The number of sets of first passageways can vary, depending on the number of differently colored paint sources (similar to the number of source tubes described above). Furthermore, the number of first passageways in each set can vary, depending on the number of spray guns (similar to the number of spray gun hoses described above). In FIG. 2, the sets of first passageways 70A–70F extend in a longitudinal direction defined by the axis of each of the first passageways 70A–70F. The second body 66 comprises a second rectangular block 76 with a set of second parallel passageways 78A–78D extending from a bottom surface 80 of the second rectangular block 76 to a top surface 82 of the second rectangular block 76 in a four by one matrix. The number of second passageways can vary, depending on the number of spray guns (similar to the number of spray gun hoses described above). Each passageway of the set of second passageways 78A–78D has the same distance between each one of them as the distance between each passageway of one of the sets of first passageways 70A–70F. Furthermore, each passageway of the plurality of sets of first passageways 70A–70F and the set of second passageways 78A–78D are parallel. The second body 66 is configured to move relatively to the first body 64 in order to selectively align one of the sets of first passageways 70A–70F in the first body 64 with the set of second passageways 78A–78D in the second body 66.

In the illustrated example, each of the first passageways 70A–70F of the first body 64 has a fitting 84 extending into the first passageways 70A–70F from the top 74 of the first body 64 (shown in phantom in FIGS. 2 and 4) and extending outwardly from the top 74 of the first body 64 for connection to the source tubes 42A–42F. The fittings 84 preferably include an enlarged middle portion 86 and are placed into the first passageways 70A–70F until the enlarged middle portion 86 abuts the top of the first body 64. The fittings 84 have tapered ends 88 and are preferably connected to the first body 64 and the source tubes 42A–42F with an interference fit. Therefore, each of the first passageways 70A–70F are fluidly connected to a differently colored paint source 18A–18E or the purging air source and valving control box assembly 40. In the illustrated example, each set of first passageways 70A–70F are fluidly connected to one of the paint canisters 44A–44E or the purging air source and valving control box assembly 40 such that all but one set of the first passageways 70A–70E is connected to one color of paint (the set of first passageways 70F is connected to the purging air source and valving control box assembly 40). Each of the first passageways 70A–70F also include an enlarged opening or counterbore 90 adjacent the bottom 72 of the first body 64. As explained in more detail below, each enlarged opening 90 accepts an enlarged head 92 of a partial fitting 94 on the second body 66 for selectively fluidly connecting the set of second passageways 78A–78D to one of the sets of first passageways 70A–70F.

Each of the illustrated second passageways 78A–78D of the second body 66 includes a fitting 84 similar to the fittings 84 of the first body 64 extending into the second passageways 78A–78D from the bottom 80 of the second body 66 and extending outwardly from the bottom 80 of the second body 66 for connection to the spray gun hoses 34A–34D connected to the spray guns 14A–14D. The fittings 84 of the second body 66 also have tapered ends 88 and preferably include the enlarged middle portion 86. The fittings of the second body 66 are placed into the second passageways 78A–78D until the enlarged middle portion 86 abuts the bottom 80 of the second body 66. The fittings 84 are preferably connected to the second body 66 and the spray gun hoses 34A–34D with an interference fit. Therefore, each of the second passageways 78A–78D is fluidly connected to a spray gun 14A–14D. The second body 66 also 5 has the partial fitting 94 extending into the second passageways 78A–78D from the top 82 of the second body 66. The partial fittings 94 also include enlarged heads 92 similar to the enlarged middle portions 86 of the fittings 84, with the enlarged heads 92 abutting the top 82 of the second body 66. The heads 92 also include an extended cylindrical portion 96 having an inside diameter equal to the inside diameter of the fittings 84. The heads 92 help to fluidly connect one of the sets of first passageways.70A–70F to the set of second passageways 78A–78D.

In the illustrated example, the second body 66 is configured to move vertically and the first body 64 is configured to move horizontally, with the top 82 of the second body 66 abutting the bottom 72, of the first body 64 when the second body 66 is at the top of its vertical stroke. The first body 64 moves horizontally in predetermined increments (shown in phantom in FIG. 2) such that one of the sets of first passageways 70A–70F is aligned with the set of second passageways 78A–78D after each incremental movement. When the bottom 72 of the first body 64 abuts the top 82 of the second body 66, the heads 92 extending from the top 82 of the second body 66 are accepted into the enlarged openings 90 of one of the sets of first passageways 70A–70F of the first body 64, thereby fluidly connecting the set of first passageways 70A–70F to the set of second passageways 78A–78D. Furthermore, the second body 66 has a greater length than the first body 64 such that all of the first passageways not connected to the set of second passageways 78A–78D are covered at the bottom 72 of the first body 64 by the top 82 of the second body 66. The second body 66 moves vertically with a stroke large enough for the heads 92 to exit the enlarged openings 90 and allow the first body 64 to move horizontally.

The illustrated first body 64 and the second body 66 are connected by vehicles the support 22, wherein the vehicles 98 move the first body 64 and the second body 66 in the respective directions. In the illustrated example, the vehicles 98 are shown as comprising a pair of pillow blocks 100. The pair of pillow blocks 100 attached to the first body 64 are arranged horizontally and ride on a horizontal first rail 102 attached to the support 22. The pair of pillow blocks 100 attached to the second body 66 are arranged horizontally and ride on a pair of vertical second rails 104 attached to the support 22. The first body 64 and the second body 66, or the pillow blocks 100 of the first body 64 and the second body 66, can be moved linearly with pneumatic or hydraulic cylinders, an electromagnetic device such as a solenoid or linear actuator, or any other device that could move the bodies.

The paint line changing assembly 16 connects the spray guns 14A–14D with one of the differently colored paint sources 18A, 18B, etc. by first moving the second body 66 to the bottom of its stroke such that the enlarged heads 92 of the partial fittings 94 of the second body 66 are not located within the enlarged openings 90 of the first body 64. Thereafter, the first body 64 is moved horizontally until the desired set of first passageways 70A–70F connected to the desired differently colored paint source 18A, 18B, etc. or the purging air source and valving control box assembly 40 is aligned with the set second passageways 78A–78D of the second body 66. The second body 66 is then moved upward with the heads 92 entering the enlarged openings 90 of the desired set of first passageways 70A–70F. The spray guns 14A–14D are therefore fluidly connected to the desired differently colored paint source 18A, 18B, etc. The first body 64 and the second body 66 could also be moved with any vehicle or in any direction as long as the desired set of first passageways 70A–70F is aligned with the set of second passageways 78A–78D after each movement. Furthermore, it is contemplated that one of the first body 64 and the second body 66 could move in more than one direction with the other of the first body 64 and the second body 66 remaining stationary, thereby aligning the desired set of first passageways 70A–70F with the set of second passageways 78A–78D and moving the first body 64 and the second body 66 together.

When a change of the color of powdered paint is desired for the spray guns 14A–14D, the controller 20 will first command the spray guns 14A–14D to stop spraying the powdered paint. Thereafter, the second body 66 will move vertically downward until the heads 92 of the second body 66 are no longer within with the enlarged openings 90 of the first body 64. The first body 64 is then moved horizontally until the set of first passageways 70A–70F connected to the purging air source and valving control box assembly 40 is aligned with the set of second passageways 78A–78D. The second body 66 is then moved upward until the heads 92 are within the enlarged openings 90 of the set of first passageways 70A–70F connected to the source tubes 42F connected to the purging air source and valving control box assembly 40. A meter amount of compressed air from the purging air source and valving control box assembly 40 is then blown through the source tubes 42F, the set of first passageways 70A–70F, the set of second passageways 78A–78D, the spray gun tubes 34A–34D and the spray guns 14A–14D. The compressed air forces any of the previous powdered paint remaining in the above elements through the sprays guns 14A–14D and into the spray booth 12 for collection. Thereafter, the second body 66 will once again move vertically downward until the heads 92 of the second body 66 are no longer within the enlarged openings 90 of the first body 64. The first body 64 is then moved horizontally until the set of first passageways 70A–70F connected to another desired differently colored powdered source 18A, 18B, etc. is aligned with the set of second passageways 78A–78D. The second body 66 is then moved upward until the heads 92 are within the enlarged openings 90 of the set of first passageways 70A–70F connected to source tubes 42A–42E connected to another desired differently colored powdered source 18A, 18B, etc. The process described directly above is repeated every time a change in powdered paint color is desired. In this manner, the paint system 10 can sequentially, repetitively and automatically paint a plurality of the products with different colors of paint. Furthermore, all of the movements of the first body 64 and the second body 66 are automatically controlled by the controller 20, although the first and second body 66 could be moved manually if a controller 20 is not running the paint system 10.

The reference numeral 216 (FIGS. 5–7) generally designates another embodiment of the present invention, having a second embodiment for the paint line changing assembly. Since paint line changing assembly 216 is similar to the previously described paint line changing assembly 16, similar parts appearing in FIGS. 24 and FIGS. 5–7, respectively, are represented by the same, corresponding reference number, except for the prefix "2" in the numerals of the latter. The illustrated paint line changing assembly 216 is configured to be attached to only one spray gun 14A to one of a plurality of different paint sources 18A–18E or the purging air source and valving control box assembly 40. However, many paint line changing assemblies 216 could be used if many spray guns are employed, with one paint line changing assembly 216 for each spray gun.

Figure 5:
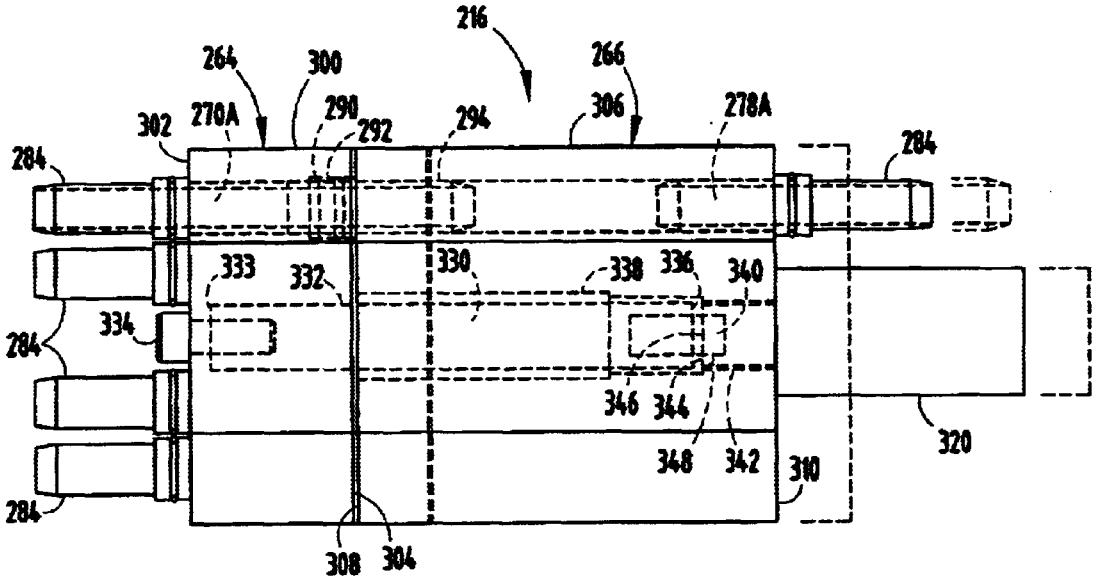
FIG. 5 is a front view of a first body and a second body of a second embodiment of the paint line changing assembly of the present invention.
Figure 6:
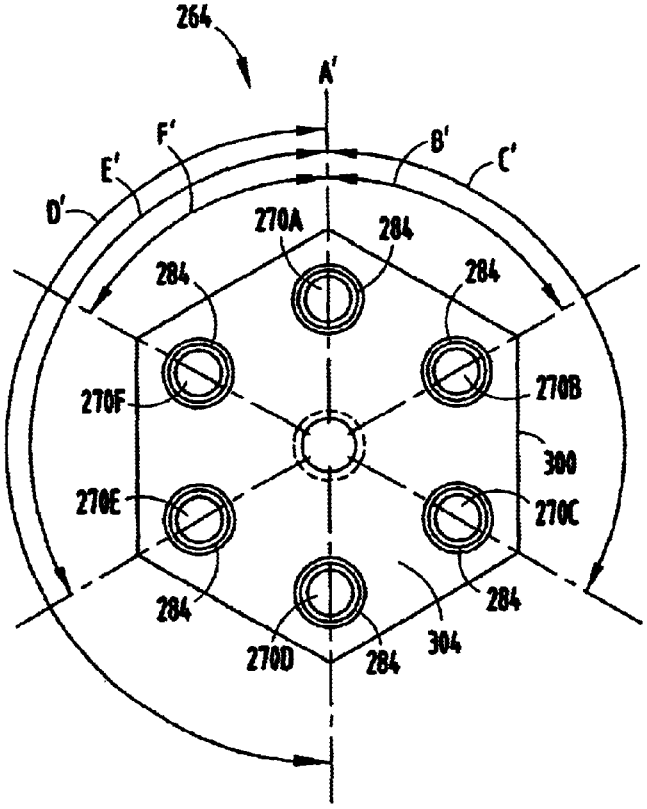
FIG. 6 is a side view of the first body of the second embodiment of the paint line changing assembly of the present invention.
Figure 7:
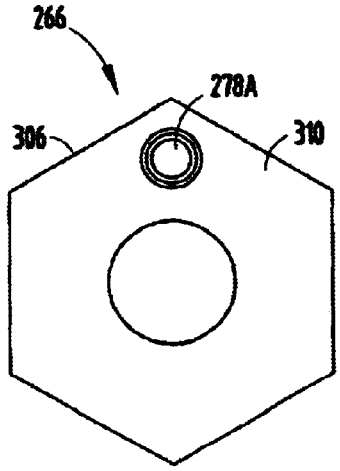
FIG. 7 is a side view of the second body of the second embodiment of the paint line changing assembly of the present invention.

The illustrated paint line changing assembly 216 includes a first body 264 positioned adjacent a second body 266. The first body 264 is in fluid communication with the plurality of differently colored paint sources 18A–18E and the second body 266 is in fluid communication. with the spray gun 14A. The first body 264 and the second body 266 are connected to a support, such as the rack 22 in FIG. 1 or any other support. The illustrated first body 264 comprises a first manifold 300 with a plurality of parallel first passageways 270A–270F extending from a first side 302 of the first manifold 300 to a second side 304 of the first manifold 300. The second body 266 comprises a second manifold 306 with a second passageway 278A extending from a first side 306 of the second manifold 308 to a second side 310 of the second manifold 306. Although the first manifold 300 and the second manifold 306 are shown in FIGS. 5–7 as having a hexagonal cross section, the first manifold 300 and the second manifold 306 could have a circular cross section, or any other geometric cross section. The second manifold 306 is configured to move relative to the first manifold 300 in order to selectively align one of the first passageways 270A–270F in the first manifold 300 with the second passageway 278A in the second manifold 306.

In the illustrated example, each of the first passageways 270A–270F of the first manifold 300 have fittings 284 extending into the first passageways 270A–270F. The fittings 284 are connected to the source tubes 42A–42F, thereby fluidly connecting each of the first passageways 270A–270F to a differently colored paint source 18A–18E or the purging air source and valving control box assembly 40. In the illustrated example, each of the first passageways 270A–270F is configured to be fluidly connected to one of the paint canisters 44A–44E or the purging air source and valving control box assembly 40 such that all but one of the first passageways 270A–270E is connected to one color of paint. Each of the first passageways 270A–270F also include enlarged openings 290 adjacent the second side 304 of the first manifold 300. Each enlarged opening 290 is configured to accept an enlarged head 292 of a partial fitting 294 on the second manifold 306 for selectively fluidly connecting the second passageway 78A to one of the first passageways 270A–270F.

The illustrated second passageway 278A of the second manifold 306 includes a fitting 284 extending into the second passageway 78A from the second side 310 of the second manifold 306 for connection to the spray gun hose 34A connected to the spray gun 14A. Therefore, the second passageway 78A is fluidly connected to the spray gun 14A. The second manifold 306 also has the partial fitting 294 extending into the second passageway 78A from the first side 308 of the second manifold 306. The partial fitting 94 includes the enlarged head 292. The head 292 helps to fluidly connect one of the first passageways 270A–270F to the second passageway 78A.

In the illustrated example, the second manifold 306 is configured to move horizontally and the first manifold 300 is configured to rotate, with the first side 308 of the second manifold 306 abutting the second side 304 of the first manifold 300 when the second manifold 306 is at the bottom of its stroke. The first manifold 300 rotates in predetermined increments A'–F' (see FIG. 6) such that one of the first passageways 270A–270F is aligned with the second passageway 78A after each incremental rotation. When the second side 304 of the first manifold 300 abuts the first side 308 of the second manifold 306, the head 292 extending from the first side 308 of the second manifold 306 is accepted into the enlarged opening 290 of one of the first passageways 270A–270F of the first manifold 300, thereby fluidly connecting one of the first passageways 270A–270F to the second passageway 78A. The second manifold 306 therefore moves horizontally with a stroke large enough for the head 292 to exit the enlarged opening 290 and allow the first manifold 300 to rotate. The first manifold 300 can be rotated with a servomotor, or pneumatic or hydraulic cylinders or motors mechanically linked to the first manifold 300 via a control arm, gearing or precision belt/pulley arrangements. The second manifold 306 can be moved linearly with pneumatic or hydraulic cylinders, an electro-magnetic device such as a solenoid or linear actuator. The first manifold 300 and the second manifold 306 could also be moved by any other device that could move the bodies. The second manifold 306 preferably includes a cylindrical handle 320 extending from the center of the second side 310 of the second manifold 306 for manually pulling the second manifold 306 away from the first manifold 300 and for manually rotating the second manifold 306 relative to the first manifold 300.

The paint line changing assembly 216 connects the spray gun 14A with one of the differently colored paint sources 18A, 18B, etc. by first moving the second manifold 306 away from the first manifold 300 such that the enlarged head 292 of the partial fitting 294 of the second manifold 306 is not located within the enlarged opening 290 of the first manifold 300. Thereafter, the first manifold 300 is rotated until the desired first passageway 270A–270F connected to the desired differently colored paint source 18A, 18B, etc. or the purging air source and valving control box assembly 40 is aligned with the second passageway 78A of the second manifold 306. The second manifold 306 is then moved back towards the first manifold 300 with the head 292 entering the enlarged opening 290 of the first passageway 270A, 270B, etc. The spray gun 214A is therefore fluidly connected to the desired differently colored paint source 18A, 18B, etc.

When a change of the color of powdered paint is desired for the spray gun 14A, the controller 20 will first command the spray gun 14A to stop spraying the powdered paint. Thereafter, the second manifold 306 will move away from the first manifold 300 until the head 292 of the second manifold 306 is no longer within with the enlarged opening 290 of the first manifold 300. The first manifold 300 is then rotated until the first passageways 70F connected to the purging air source and valving control box assembly 40 is aligned with the second passageway 278A. The second manifold 306 is then moved towards the first manifold 300 until the head 292 is within the enlarged opening 290 of the first passageway 270A connected to the source tubes 42F connected to the purging air source and valving control box assembly 40. Air from the purging air source and valving control box assembly 40 is then blown through the source tube 42F, the first passageway 270A, 270B, etc., the second passageway 278A, the spray gun tube 34A and the spray gun 14A, thereby cleaning the powdered paint out of the above elements. Thereafter, the second manifold 306 will once again move away from the first manifold 300 until the head 292 of the second manifold 306 is no longer within the enlarged opening 290 of the first manifold 300. The first manifold 300 is then rotated until the first passageways 70A–70F connected to another desired differently colored powdered source 18A, 18B, etc. is aligned with the second passageway 78A. The second manifold 306 is then moved towards the first manifold 300 until the head 292 is within the enlarged opening 290 of the first passageways 270A–270E connected to source tubes 42A–42E connected to another desired differently colored powdered source 18A, 18B, etc. The process described directly above is repeated every time a change in powdered paint color is desired. In this manner, the paint system 10 can sequentially, repetitively and automatically paint a plurality of products with different colors of paint. Furthermore, all of the movements of the first manifold 300 and the second manifold 306 are automatically controlled by the controller 20, although the first manifold 300 and second manifold 306 could be moved manually if a controller 20 is not running the paint system 10.

When the paint line changing assembly 216 is configured to be manually controlled, a pin 330 located in the first manifold 300 and the second manifold 306 helps to bias the first manifold 300 and the second manifold 306 together. The illustrated pin 330 extends along the axis of the first manifold 300 and is positioned in an axial opening 332 located in the second side 304 of the first manifold 300. A first end 333 of the pin 330 is connected to a fastener 334 extending through the first side 302 of the first manifold 300 and into the axial opening 332. A second end 336 of the pin 330 extends outwardly from the second side 304 of the first manifold 300. The second manifold 306 includes an axial bore 338, with the pin 300 extending into the axial bore 338 of the second manifold 306. A fastener 340 on the second end 336 of the pin 330 extends into a small bore 342 aligned with the axial bore 338 in a central portion of the second manifold 306. An annular wall 344 with a circular opening 346 is located between the axial bore 338 and the small bore 342 of the second manifold 306, with the fastener 340 attached to the pin 300 extending through the circular opening 346. A coil spring 348 smaller than the small bore 342 but larger than the circular opening 346 is located in the small bore 342 and connected to the fastener 340, such that the coil spring 348 does not fit within the circular opening 346. The coil spring 348 therefore attaches the first manifold 300 to the second manifold 306 by retaining the second end 336 of the pin 330 of the first manifold 300 within the second manifold 306. The coil spring 348, however, is free to rotate within the second manifold 306 such that the first manifold 300 and the second manifold 306 are rotatably connected. The coil spring 348 also biases the pin 330 such that the first manifold 300 and the second manifold 306 are biased towards each other along their respective axes. Therefore, the second manifold 306 can be pulled away from the first manifold 300 with the handle 320 to index the second passageway 278A with one of the first passageways 270A–270F and the second manifold 306 will therefore be forced towards the first manifold 300 after the indexing by the force of the coil spring 348.

The above description is considered that of the preferred embodiments only. Modification of the invention will occur to those skilled in the art and to those who make or use the invention. For example, liquid paint of other liquids can be sprayed through the spray guns, with the spray gun hoses, the source tubes and the paint line changing assembly being flushed with a flushing liquid instead of air. Therefore, it is understood that the embodiments shown in the drawings and described above are merely for illustrative purposes and not intended to limit the scope of the invention, which is defined by the following claims as interpreted according to the principles of patent law, including doctrine of equivalents.

The invention claimed is:

1. A paint system comprising:

at least one spray gun;

a paint line changing assembly;

a plurality of differently colored paint sources; the paint line changing assembly being configured to selectively connect the at least one spray gun with one of the plurality of differently colored paint sources; and a controller for maintaining at least one of the plurality of differently colored paint sources in a partially fluidized state when not connected to the at least one spray gun and for maintaining the one of the plurality of differently colored paint sources in an operative fluidized state when connected to the at least one spray gun;

wherein a partially fluidized pressure of the at least one of the plurality of differently colored paint sources in the partially fluidized state is lower than an operative fluidized pressure of the one of the plurality of differently colored paint sources in the operative fluidized state;

wherein the paint line changing assembly comprises:

a first body including a plurality of first passageways, each first passageway being in fluid communication with a different one of the plurality of differently colored paint sources; and a second body including a second passageway, the second passageway of the second body being in fluid communication with the spray gun;

wherein one of the first body and the second body is configured to move relative to the other of the first body and the second body to selectively index one of the first passageways in the first body with the second passageway of the second body, thereby fluidly connecting one of the plurality of differently colored paint sources to the at least one spray gun;

a first vehicle connected to the first body moves the first body by linearly translating the first vehicle along a first track; and a second vehicle connected to the second body moves the second body by linearly translating the second vehicle along a second track;

the first track being perpendicular to the second track.

2. The paint system as set forth in claim 1, wherein:

the paint line changing assembly is further configured to automatically connect the at least one spray gun with one of the plurality of differently colored paint sources.

3. The paint system as set forth in claim 2, further including:

a purging air source;

wherein the paint line changing assembly is configured to automatically and selectively connect the at least one spray gun with one of the plurality of differently colored paint sources or the purging air source, thereby allowing the paint system to sequentially, repetitively and automatically select a colored paint from one of the plurality of differently colored paint sources, purge paint in the paint line changing assembly and the spray gun by connecting the paint line changing assembly and the spray gun to the purging air source, and select another colored paint from another one of the plurality of differently colored paint sources.

4. The paint system as set forth in claim 1, wherein:

the first body and the second body are moved to selectively index one of the first passageways in the first body with the second passageway of the second body.

5. The paint system as set forth in claim 1, wherein:

the at least one spray gun includes a plurality of spray guns;

the first body includes a plurality of sets of the first passageways, each set of the first passageways being in fluid communication with one of the plurality of differently colored paint sources; and the second body including a set of second passageways, the second passageways of the second body being in fluid communication with the plurality of spray guns;

wherein each set of first passageways are configured to be selectively indexed with the set of second passageways of the second body, thereby fluidly connecting one of the plurality of differently colored paint sources to the plurality of spray guns.

6. The paint system as set forth in claim 1, wherein:

one of the first body and the second body includes fittings having a head extending from its respective passageways towards the other of the first body and the second body, and the other of the first body and the second body includes enlarged openings for accepting the heads extending from the one of the first body and the second body.

7. The paint system as set forth in claim 1, wherein:

the partially fluidized state is less than about half the fluidized pressure of the operative fluidized state.

8. The paint system as set forth in claim 1, wherein:

the at least one spray gun includes a plurality of spray guns;

the one of the plurality of differently colored paint sources includes a plurality of substantially identically colored paint canisters; and each spray gun is configured to be connected to one of the canisters of the one of the plurality of differently colored paint sources.

9. The paint system as set forth in claim 1, wherein:

the at least one spray gun includes a plurality of spray guns;

the one of the plurality of differently colored paint sources includes a colored paint canister; and each spray gun is configured to be simultaneously connected to the canister of the one of the plurality of differently colored paint sources.

10. The paint system as set forth in claim 1, further including:

a spray booth;

wherein the at least one spray guns are located with the spray booth and the paint line changing assembly is positioned outside of the spray booth.

11. A paint system comprising:

a paint line changing assembly; and a plurality of differently colored paint sources;

the paint line changing assembly being configured to selectively connect at least one spray gun with one of the plurality of differently colored paint sources; and a controller for maintaining at least one of the plurality of differently colored paint sources in a partially fluidized state when not connected to the at least one spray gun and maintaining the one of the plurality of differently colored paint sources in an operative fluidized state when connected to the at least one spray gun;

wherein a partially fluidized pressure of the at least one of the plurality of differently colored paint sources in the partially fluidized state is lower than an operative fluidized pressure of the one of the plurality of differently colored paint sources in the operative fluidized state;

wherein the paint line changing assembly comprises:

a first body including a plurality of first passageways, each first passageway being in fluid communication with a different one of the plurality of differently colored paint sources; and a second body including a second passageway, the second passageway of the second body being in fluid communication with the spray gun;

wherein one of the first body and the second body is configured to move relative to the other of the first body and the second body to selectively index one of the first passageways in the first body with the second passageway of the second body, thereby fluidly connecting one of the plurality of differently colored paint sources to the at least one spray gun;

a first vehicle connected to the first body moves the first body by linearly translating the first vehicle along a first track; and a second vehicle connected to the second body moves the second body by linearly translating the second vehicle along a second track;

the first track being perpendicular to the second track.

12. The paint system as set forth in claim 11, wherein:

the paint line changing assembly is further configured to automatically connect the at least one spray gun with one of the plurality of differently colored paint sources.

13. The paint system as set forth in claim 12, further including:

a purging air source;

wherein the paint line changing assembly is configured to automatically and selectively connect the at least one spray gun with one of the plurality of differently colored paint sources or the purging air source, thereby allowing the paint system to sequentially, repetitively and automatically select a colored paint from one of the plurality of differently colored paint sources, purge paint in the paint line changing assembly and the spray gun by connecting the paint line changing assembly and the spray gun to the purging air source, and select another colored paint from another one of the plurality of differently colored paint sources.

14. The paint system as set forth in claim 11, wherein:

the first body and the second body are moved to selectively index one of the first passageways in the first body with the second passageway of the second body.

15. The paint system as set forth in claim 11, wherein:

the at least one spray gun includes a plurality of spray guns;

the first body includes a plurality of sets of the first passageways, each set of first passageways being in fluid communication with one of the plurality of differently colored paint sources; and the second body including a set of second passageways, the second passageways of the second body being in fluid communication with the plurality of spray guns;

wherein each set of passageways are configured to be selectively indexed with the set of second passageways of the second body, thereby fluidly connecting one of the plurality of differently colored paint sources to the plurality of spray guns.

16. The paint system as set forth in claim 11, wherein:

one of the first body and the second body includes fittings having a head extending from its respective passageways towards the other of the first body and the second body, and the other of the first body and the second body includes enlarged openings for accepting the heads extending from the one of the first body and the second body.

17. The paint system as set forth in claim 11, wherein:

each of the plurality of differently colored paint sources includes a pump and a valving arrangement; and the valving arrangement including a first regulator constructed to hold the paint sources in a partially fluidized state and including a second regulator constructed to hold the paint sources at a operative fluidized state.

18. The paint system as set forth in claim 17, wherein:

the partially fluidized state is less than about half of the fluidized pressure of the operative fluidized state.

19. The paint system as set forth in claim 11, wherein:

the at least one spray gun includes a plurality of spray guns;

the one of the plurality of differently colored paint sources includes a plurality of substantially identically colored paint canisters; and each spray gun is configured to be connected to one of the canisters of the one of the plurality of differently colored paint sources.

20. The paint system as set forth in claim 11, wherein:

the at least one spray gun includes a plurality of spray guns;

the one of the plurality of differently colored paint sources includes a colored paint canister; and each spray gun is configured to be simultaneously connected to the canister of the one of the plurality of differently colored paint sources.

21. A paint system comprising:

a plurality of differently colored paint sources;

a plurality of spray guns; and a paint line changing assembly including:

a first body including a plurality of sets of first passageways, each set of first passageways being in fluid communication with a different one of the plurality of different paint sources; and a second body including a set of second passageways, the second passageways of the second body being in fluid communication with the plurality of spray guns;

a support for the first and second bodies;

wherein one of the first body and the second body is configured to move relative to the support in a first direction parallel to the longitudinal direction, and the other of the first body and the second body is configured to move in a second direction different from the first direction to selectively align one of the sets of first passageways in the first body with the set of second passageways of the second body, thereby fluidly connecting one of the plurality of differently colored paint sources to the plurality of spray guns.

22. The paint system as set forth in claim 21, wherein:

one of the first body and the second body includes fittings having a head extending a from its respective passageways towards the other of the first body and the second body, and the other of the first body and the second body includes enlarged openings for accepting the heads extending from the one of the first body and the second body.

23. The paint system as set forth in claim 21, wherein:

the support includes a first vehicle connected to the first body and a second vehicle connected to the second body;

the first vehicle connected to the first body moves the first body by linearly translating the first vehicle along a first track; and the second vehicle connected to the second body moves the second body by linearly translating the second vehicle along a second track;

the first track being perpendicular to the second track.

24. The paint system as set forth in claim 21, wherein:

each of the plurality of differently colored paint sources includes a plurality of substantially identically colored paint canisters; and each spray gun is configured to be connected to one of the canisters of the one of the plurality of differently colored paint sources.

25. The paint system as set forth in claim 21, wherein:

each of the plurality of differently colored paint sources includes a colored paint canister; and each spray gun is configured to be simultaneously connected to the canister of the one of the plurality of differently colored paint sources.

26. A paint system comprising:

at least one spray gun;

a paint line changing assembly;

a plurality of differently colored paint sources;

the paint line changing assembly being configured to selectively connect the at least one spray gun with one of the plurality of differently colored paint sources; and a controller for maintaining at least one of the plurality of differently colored paint sources in a partially fluidized state when not connected to the at least one spray gun and for maintaining the one of the plurality of differently colored paint sources in an operative fluidized state when connected to the at least one spray gun;

wherein the paint line changing assembly comprises a first body including a plurality of first passageways, with each first passageway being in fluid communication with a different one of the plurality of differently colored paint sources, and a second body including a second passageway, with the second passageway of the second body being in fluid communication with the spray gun;

wherein one of the first body and the second body is configured to move relative to the other of the first body and the second body to selectively index one of the first passageways in the first body with the second passageway of the second body, thereby fluidly connecting one of the plurality of differently colored paint sources to the at least one spray gun;

wherein a first vehicle is connected to the first body and moves the first body by linearly translating the first vehicle along a first track;

wherein a second vehicle is connected to the second body and moves the second body by linearly translating the second vehicle along a second track; and wherein the first track is perpendicular to the second track.

27. The paint system as set forth in claim 26, wherein:

the paint line changing assembly is further configured to automatically connect the at least one spray gun with one of the plurality of differently colored paint sources.

28. The paint system as set forth in claim 27, further including:

a purging air source;

the paint line changing assembly being configured to automatically and selectively connect the at least one spray gun with one of the plurality of differently colored paint sources or the purging air source, thereby allowing the paint system to sequentially, repetitively and automatically select a colored paint from one of the plurality of differently colored paint sources, purge paint in the paint line changing assembly and the spray gun by connecting the paint line changing assembly and the spray gun to the purging air source, and select another colored paint from another one of the plurality of differently colored paint sources.

29. The paint system as set forth in claim 26, wherein:

the at least one spray gun includes a plurality of spray guns;

the first body includes a plurality of sets of the first passageways, each set of the first passageways being in fluid communication with one of the plurality of differently colored paint sources;

the second body including a set of second passageways, the second passageways of the second body being in fluid communication with the plurality of spray guns; and each set of first passageways are configured to be selectively indexed with the set of second passageways of the second body, thereby fluidly connecting one of the plurality of differently colored paint sources to the plurality of spray guns.

30. The paint system as set forth in claim 26, wherein:

one of the first body and the second body includes fittings having a head extending from its respective passageways towards the other of the first body and the second body, and the other of the first body and the second body includes enlarged openings for accepting the heads extending from the one of the first body and the second body.

31. The paint system as set forth in claim 26, wherein:

a partially fluidized pressure of the at least one of the plurality of differently colored paint sources in the partially fluidized state is lower than an operative fluidized pressure of the one of the plurality of differently colored paint sources in the operative fluidized state.

32. The paint system as set forth in claim 31, wherein:

the partially fluidized state is less than about half the fluidized pressure of the operative fluidized state.

33. The paint system as set forth in claim 26, wherein:

the at least one-spray gun includes a plurality of spray guns;

the one of the plurality of differently colored paint sources includes a plurality of substantially identically colored paint canisters; and each spray gun is configured to be connected to one of the canisters of the one of the plurality of differently colored paint sources.

34. The paint system as set forth in claim 26, wherein:

the at least one spray gun includes a plurality of spray guns;

the one of the plurality of differently colored paint sources includes a colored paint canister; and each spray gun is configured to be simultaneously connected to the canister of the one of the plurality of differently colored paint sources.

35. The paint system as set forth in claim 26, further including:

a spray booth;

wherein the at least one spray guns are located with the spray booth and the paint line changing assembly is positioned outside of the spray booth.

36. A paint system comprising:

a paint line changing assembly; and a plurality of differently colored paint sources;

the paint line changing assembly being configured to selectively connect at least one spray gun with one of the plurality of differently colored paint sources; and a controller for maintaining at least one of the plurality of differently colored paint sources in a partially fluidized state when not connected to the at least one spray gun and maintaining the one of the plurality of differently colored paint sources in an operative fluidized state when connected to the at least one spray gun;

wherein the paint line changing assembly comprises a first body including a plurality of first passageways, with each first passageway being in fluid communication with a different one of the plurality of differently colored paint sources, and a second body including a second passageway, with the second passageway of the second body being in fluid communication with the spray gun;

wherein one of the first body and the second body is configured to move relative to the other of the first body and the second body to selectively index one of the first passageways in the first body with the second passageway of the second body, thereby fluidly connecting one of the plurality of differently colored paint sources to the at least one spray gun;

wherein a first vehicle is connected to the first body and moves the first body by linearly translating the first vehicle along a first track;

wherein a second vehicle is connected to the second body and moves the second body by linearly translating the second vehicle along a second track; and wherein the first track is perpendicular to the second track.

37. The paint system as set forth in claim 36, wherein:

the paint line changing assembly is further configured to automatically connect the at least one spray gun with one of the plurality of differently colored paint sources.

38. The paint system as set forth in claim 37, further including:

a purging air source;

the paint line changing assembly being configured to automatically and selectively connect the at least one spray gun with one of the plurality of differently colored paint sources or the purging air source, thereby allowing the paint system to sequentially, repetitively and automatically select a colored paint from one of the plurality of differently colored paint sources, purge paint in the paint line changing assembly and the spray gun by connecting the paint line changing assembly and the spray gun to the purging air source, and select another colored paint from another one of the plurality of differently colored paint sources.

39. The paint system as set forth in claim 36, wherein:

the at least one spray gun includes a plurality of spray guns;

the first body includes a plurality of sets of the first passageways, each set of first passageways being in fluid communication with one of the plurality of differently colored paint sources; and the second body including a set of second passageways, the second passageways of the second body being in fluid communication with the plurality of spray guns;

wherein each set of passageways are configured to be selectively indexed with the set of second passageways of the second body, thereby fluidly connecting one of the plurality of differently colored paint sources to the plurality of spray guns.

40. The paint system as set forth in claim 36, wherein:

one of the first body and the second body includes fittings having a head extending from its respective passageways towards the other of the first body and the second body, and the other of the first body and the second body includes enlarged openings for accepting the heads extending from the one of the first body and the second body.

41. The print system as set forth in claim 36, wherein:

a partially fluidized pressure of the at least one of the plurality of differently colored paint sources in the partially fluidized state is lower than an operative fluidized pressure of the one of the plurality of differently colored paint sources in the operative fluidized state.

42. The paint system as set forth in claim 41, wherein:

the partially fluidized state is less than about half of the fluidized pressure of the operative fluidized state.

43. The paint system as set forth in claim 36, wherein:

each of the plurality of differently colored paint sources includes a pump and a valving arrangement; and the valving arrangement including a first regulator constructed to hold the paint sources in a partially fluidized state and including a second regulator constructed to hold the paint sources at a operative fluidized state.

44. The paint system as set forth in claim 36, wherein:

the at least one spray gun includes a plurality of spray guns;

the one of the plurality of differently colored paint sources includes a plurality of substantially identically colored paint canisters; and each spray gun is configured to be connected to one of the canisters of the one of the plurality of differently colored paint sources.

45. The paint system as set forth in claim 36, wherein:

the at least one spray gun includes a plurality of spray guns;

the one of the plurality of differently colored paint sources includes a colored paint canister; and each spray gun is configured to be simultaneously connected to the canister of the one of the plurality of differently colored paint sources.

* * * * *

UNITED STATES PATENT AND TRADEMARK OFFICE

CERTIFICATE OF CORRECTION

PATENT NO. : 6,705,545 B1
DATED : March 16, 2004
INVENTOR(S) : Jerome J. Sroka et al.

It is certified that error appears in the above-identified patent and that said Letters Patent is hereby corrected as shown below:

Title page,
Item [57], ABSTRACT,
Line 2, delete “located”.

Column 2,
Line 26, after “one” insert -- of --.

Column 5,
Line 3, “14A-142” should be -- 14A-14D --.
Line 64, after “pump” delete “.”.

Figure 3:
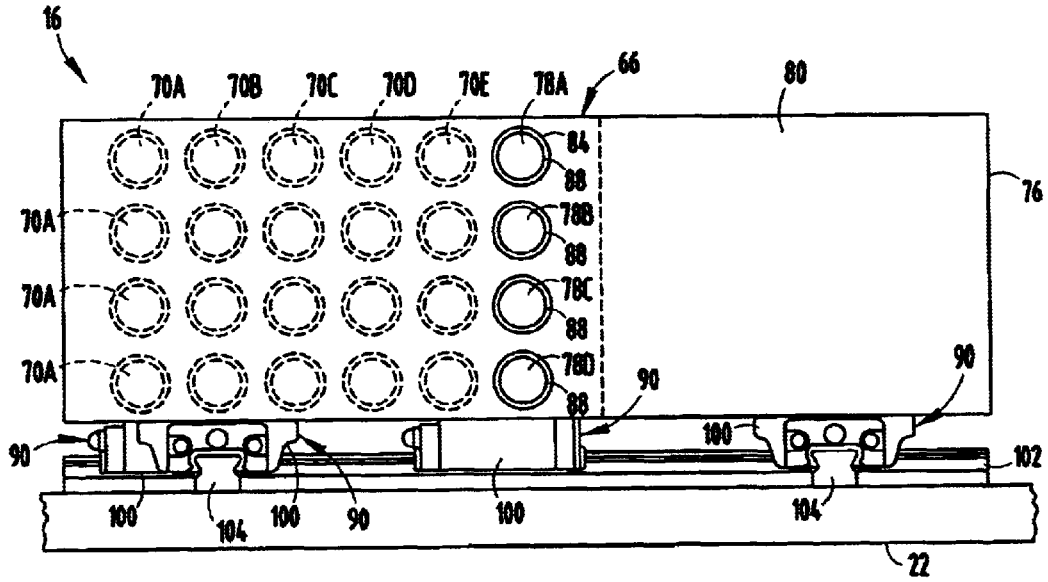
FIG. 3 is a bottom view of the first body of the first embodiment of the paint line changing assembly of the present invention.
Figure 4:
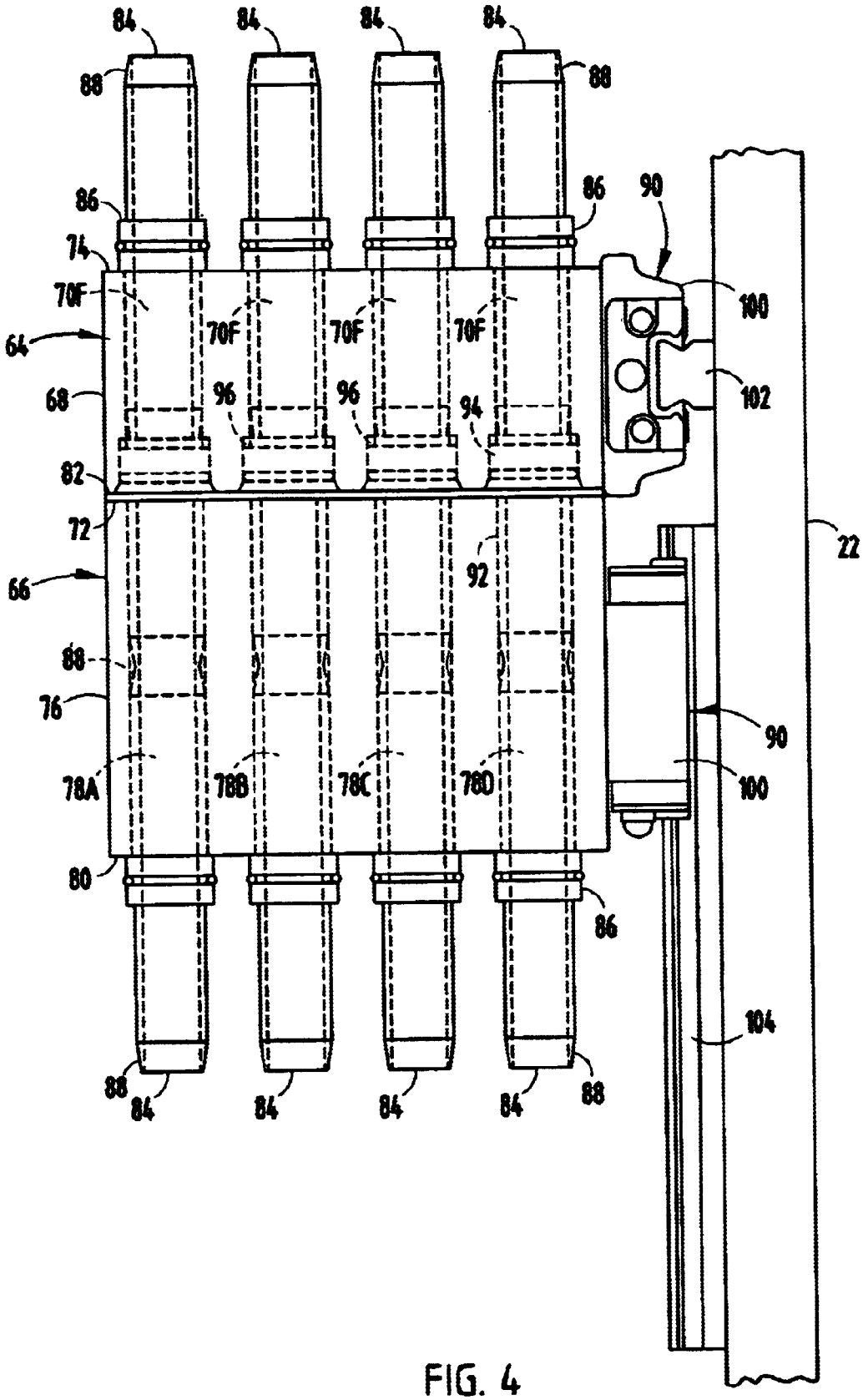
FIG. 4 is a side view of the first body and the second body of the first embodiment of the paint line changing assembly of the present invention.

Column 6,
Lines 59-60, “(Figs. 24)” should be -- Figs. 2-4) --.

Column 8,
Line 10, delete “5”.
Line 19, after “passageways” delete “.”.
Line 45, after “vehicles” insert --98 to --.

Column 9,
Line 25, delete “with”.
Line 60, after “first” insert -- body 64 --.
Line 22, “Figs. 24” should be -- Figs. 2-4 --.

Column 10,
Line 14, after “communication” delete “.”.

Column 11,
Line 51, delete “with”.

UNITED STATES PATENT AND TRADEMARK OFFICE

CERTIFICATE OF CORRECTION

PATENT NO. : 6,705,545 B1
DATED : March 16, 2004
INVENTOR(S) : Jerome J. Sroka et al.

It is certified that error appears in the above-identified patent and that said Letters Patent is hereby corrected as shown below:

Column 16,
Line 58, delete “a” after “extending”.

Column 20,
Line 39, “a” should be -- an --.

Signed and Sealed this

Tenth Day of August, 2004

JON W. DUDAS
*Acting Director of the United States Patent and Trademark Office*